US008418939B2

(12) United States Patent
Peng et al.

(10) Patent No.: US 8,418,939 B2
(45) Date of Patent: Apr. 16, 2013

(54) SHOWER HAVING A SHOWER AREA CHANGED WITH VARIATION OF WATER PRESSURE

(75) Inventors: Haisong Peng, Xiamen (CN); Jianmin Chen, Xiamen (CN); Shenghe Chen, Xiamen (CN); Huasong Zhou, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 555 days.

(21) Appl. No.: 12/637,072

(22) Filed: Dec. 14, 2009

(65) Prior Publication Data

US 2011/0139886 A1 Jun. 16, 2011

(51) Int. Cl.

| | |
|---|---|
| ***A62C 31/00*** | (2006.01) |
| ***A62C 37/20*** | (2006.01) |
| ***B05B 1/30*** | (2006.01) |
| ***B05B 1/34*** | (2006.01) |

(52) U.S. Cl.
USPC ..... 239/445; 239/444; 239/448; 239/533.13; 239/562; 239/563; 239/570

(58) Field of Classification Search ..... 239/533.13, 239/569, 562, 570–572, 448, 563, 559–561, 239/390, 444, 445, 583, 443
See application file for complete search history.

(56) References Cited

U.S. PATENT DOCUMENTS

| | | | | |
|---|---|---|---|---|
| 4,479,610 | A * | 10/1984 | Etheridge et al. | 239/171 |
| 6,869,030 | B2 * | 3/2005 | Blessing et al. | 239/394 |
| 7,331,536 | B1 * | 2/2008 | Zhen et al. | 239/449 |
| 7,384,007 | B2 * | 6/2008 | Ho | 239/570 |
| 7,766,260 | B2 * | 8/2010 | Lin | 239/449 |
| 7,992,807 | B2 * | 8/2011 | Pan | 239/449 |
| 2003/0034072 | A1 * | 2/2003 | Bui et al. | 137/514 |

FOREIGN PATENT DOCUMENTS

| | | |
|---|---|---|
| CN | 201040267 Y | 3/2008 |

* cited by examiner

*Primary Examiner* — Ryan Reis
(74) *Attorney, Agent, or Firm* — Rabin & Berdo, P.C.

(57) ABSTRACT

A shower having a shower area changed with variation of water pressure includes: a holding unit, in which a water channel is designed and a feed-water valve is added on the top of the water channel; a spraying water unit, which is sealed with the holding unit, comprising at least two spraying water groups that are a main spraying water group and at least one branch spraying water group; and at least one movable unit, whose number is equal with the number of branch spraying water groups, assembled with the branch spraying water groups in one to one correspondence. In order to change the shower area, we could regulate the opening and closing of the feed-water valve to control water pressure.

6 Claims, 7 Drawing Sheets

SHOWER HAVING A SHOWER AREA CHANGED WITH VARIATION OF WATER PRESSURE

FIELD OF INVENTION

This invention relates to a type of shower, which has a shower area changed with variation of water pressure.

BACKGROUND OF THE INVENTION

When we are having a shower, we could add the fun and get different shower effects in order to save water, if we could regulate the shower area. Chinese patent application No. CN200720006856.5, the utility model named multifunction shower water structure, includes a device of water inlet, switching regulation device and device of spraying water. Through switching different water cavities with two interacting ceramic chips, we could get the regulation effect of the multifunctional water outlet of this utility model. This shower has the following shortages, comprising:

1. The structure of the shower is complex, and it requires high assembly accuracy.

2. The shower additionally needs a switching regulation, resulting in increasing its weight and complicating the manufacturing process, so the manufacturing cost increases.

3. Although this shower could take different effects of spraying water, it still could not regulate the scale of shower area.

SUMMARY OF THE INVENTION

This invention is a shower having a shower area changed with variation of water pressure, which improves the shortages of the multifunction shower water structure in background of the invention.

In the present invention, one of the technical programmes to solve the technical problems is:

A shower having shower area changed with variation of water pressure, includes:

A holding unit, through which a water channel is laid out;

A spraying water unit, which is sealed with the holding unit, wherein in a middle cavity is formed between them, connecting with the water channel, has at least two spraying water groups, each of which has a water inlet hole connecting with the middle cavity and several water outlet holes connecting with the water inlet hole;

At least one movable unit, each of which has a assembly groove is designed mouth-down in the holding unit, a seal unit sliding connected with the assembly groove and sealing it, and a elastic body laid out in the assembly groove, pressing outwards against the seal unit;

Wherein, when water pressure to the seal unit is less than the elastic force of the elastic body, the seal unit slides outwards to seal the water inlet hole; when water pressure to the seal unit is more than the elastic force of the elastic body, the seal unit slides inwards to connect the water inlet hole with the middle cavity.

In one preferable embodiment, the seal unit comprises a multi-diameter and big end up piston and a seal fixed at the bottom of the piston that has a step plane bearing water pressure.

In one preferable embodiment, these spraying water groups is divided into a main spraying water group constantly connecting with the middle cavity and at least one branch spraying water group, whose number is equal with the number of movable units, assembled with movable units in one to one correspondence.

In one preferable embodiment, the water outlet holes of the branch spraying group is laid out in a circle, surrounding the water outlet holes of the main spraying water group.

In one preferable embodiment, the branch spraying groups is at least two, and the elastic coefficients of the elastic bodies in these movable units are different.

In one preferable embodiment, the branch spraying groups is at least two, and the preloads of the elastic bodies in these movable units are different.

In one preferable embodiment, the assembly groove forms a through hole, and a nut, fixed on the top of the hole, seals the top opening of it. The seal unit, sealing the through hole, is sliding connected with it, and in the hole the elastic body is pressed between the nut and the seal unit. In one preferable embodiment, a positioning column is fixed on the upper surface of the piston, and the elastic body is a coil spring, covering the positioning column.

In one preferable embodiment, a feed-water valve, which could control water flow, is set up in the water channel.

In the present invention, the other of the technical programmes to solve the technical problems is:

A working method of the shower having a shower area changed with variation of water pressure, comprising:

Step$_{[s1]}$10, input water pressure change;

Step 20, execute in accordance with water pressure change;

Step 21, when water pressure to the seal unit is more than the elastic force of elastic body, the seal unit slide away from the water inlet hole of the spraying water group to connect the water inlet hole with middle cavity, then water could flow out of these water outlet holes of the is spraying water group, as a result of increasing the shower area;

Step 22, when water pressure to the seal unit is less than the elastic force of elastic body, the seal unit slides close to and seals the water inlet hole of the spraying water group, then water could not flow out of these water outlet holes of the spraying water group, as a result of decreasing the shower area.

Compared with the technical programmes in the background of the invention, the present technical programmes has the following advantages, comprising:

1. The structure of the shower is simple, and it needs no device of regulating shower area. So the present invention simplifies the manufacturing process and reduces manufacturing cost;

2. The shower has at least two spraying water groups to make the effects of changing shower area more diverse, and user could control the shower area by regulating tap or valve;

3. The holding unit, the spraying water unit, and the movable unit are working together to make the process of changing shower area more fluent and natural, and the elastic coefficient of the elastic body, which is pressing against the seal unit in the movable unit, is defaulted;

4. The water outlet holes of the branch spraying group is laid out in a circle, surrounding the water outlet holes of the main spraying water group, and this kind of design is artistic and natural;

5. The preloads or the elastic coefficients of all the spraying water groups are different, so there are multiple scales of changing shower area.

Figure 1:
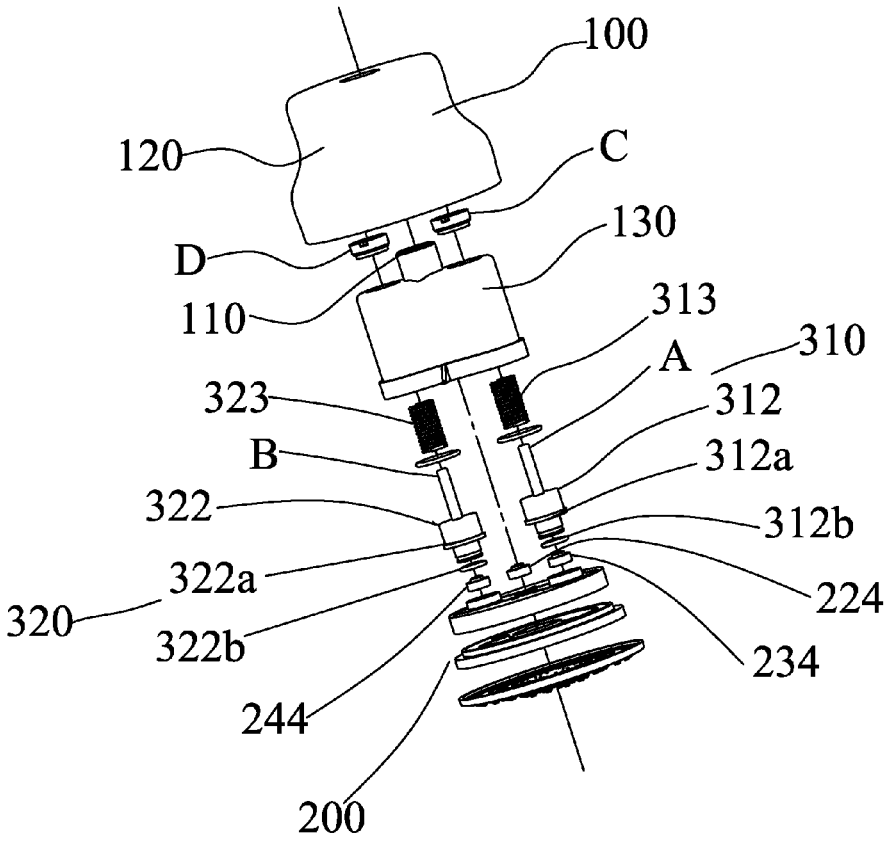
FIG. 1 is an exploded perspective view illustrating the shower having a shower area changed with variation of water pressure in a preferable embodiment of the present invention.

DESCRIPTION OF MARKS IN THE DRAWINGS holding unit-100; water channel-110; casing-120; cylinder block-130; spraying water unit-200; middle cavity-210; main spraying water group-220; main water inlet holes-221; main water outlet holes-222; main water outlet cavity-223; main water-saving chip-224; first branch spraying water group-230; first branch water inlet holes-231; first branch is water outlet holes-232; first branch water outlet cavity-233; second branch spraying water group-240; second branch water inlet holes-241; second branch water outlet holes-242; second branch water outlet cavity-243; second branch water-saving chip-244; first movable unit-310; first assembly groove-311; first seal unit-312; first piston-312*a*; first seal-312*b*; first spring-313; second movable unit-320; second assembly groove-321; second seal unit-322; second piston-322*a*; second seal-32*b*; second spring-323; positioning column-A, B; nut-C, D

DESCRIPTION OF SPECIFIC EMBODIMENTS

Referring now to FIG. 1-FIG. 7, one embodiment of the shower according to the invention is shown, the shower area can be changed with variation of water pressure.

Figure 2:
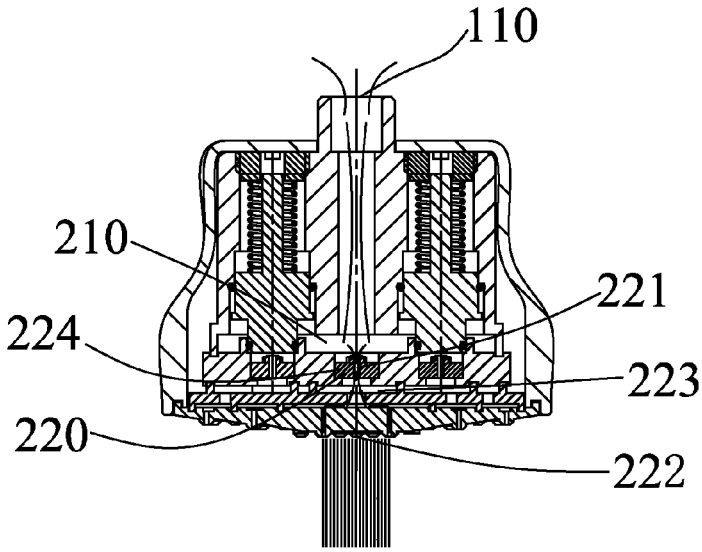
FIG. 2 is a longitude sectional view illustrating the shower having a shower area changed with variation of water pressure in a preferable embodiment of the present invention, when water is flowing out of the main water outlet holes of the main spraying water group.
Figure 3:
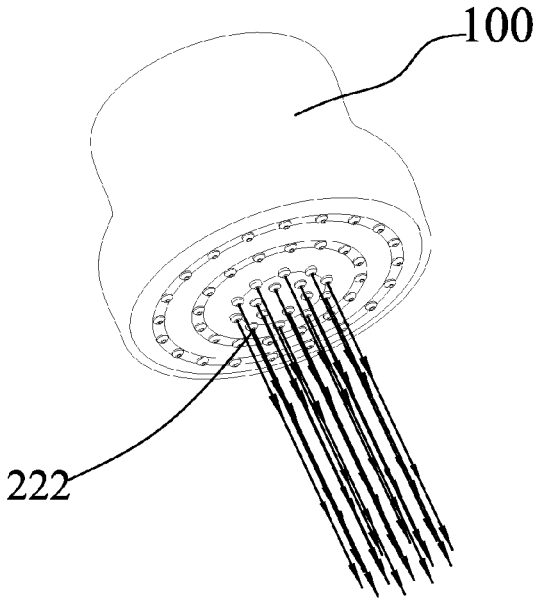
FIG. 3 is a three-dimensional view illustrating the shower having a shower area changed with variation of water pressure in a preferable embodiment of the present invention, when water is flowing out of the main water outlet holes of the main spraying water group.
Figure 4:
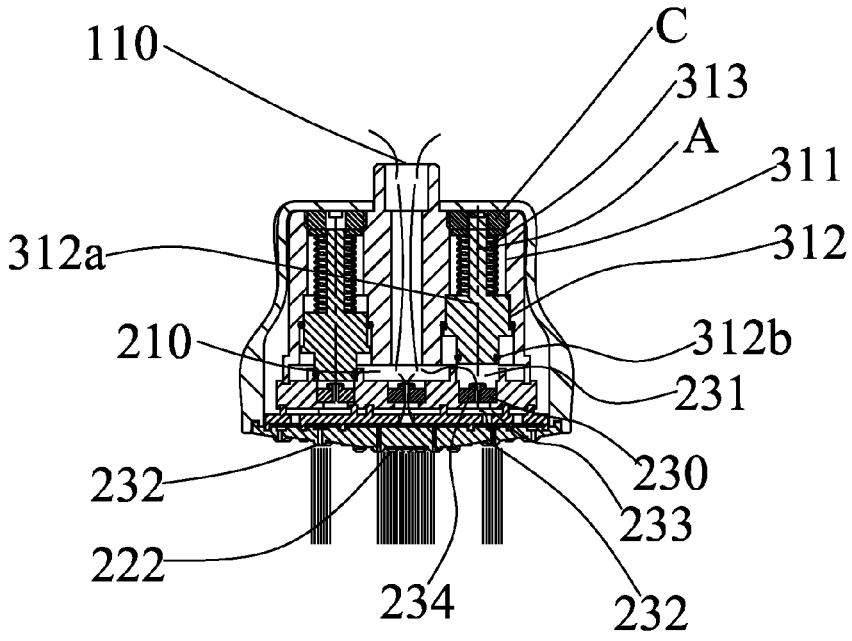
FIG. 4 is a longitude sectional view illustrating the shower having a shower area changed with variation of water pressure in a preferable embodiment of the present invention, when water is flowing out of the main water outlet holes of the main spraying water group, and the first branch water outlet holes of the first branch spraying water group.
Figure 5:
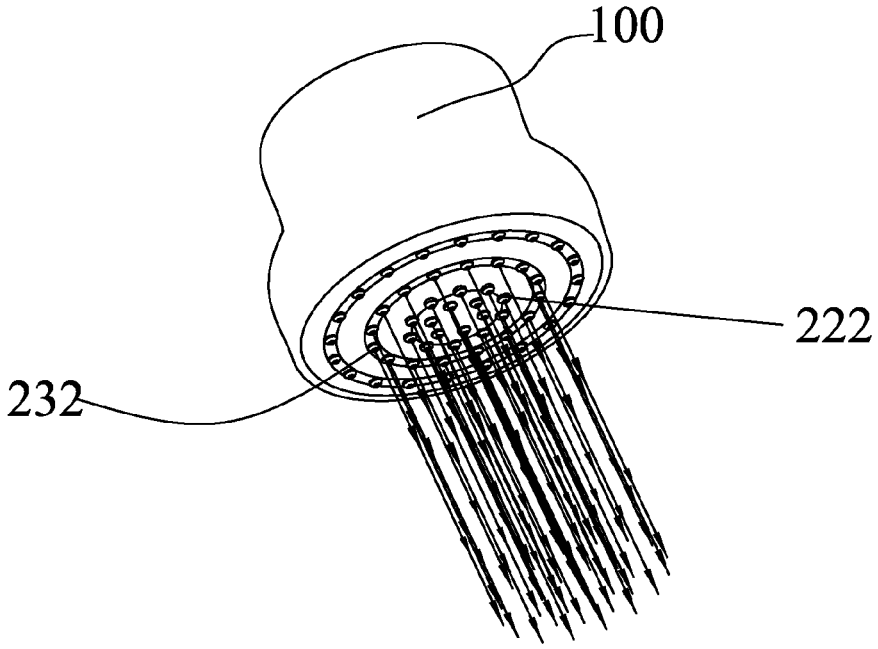
FIG. 5 is a three-dimensional view illustrating the shower having a shower area changed with variation of water pressure in a preferable embodiment of the present invention, when water is flowing out of the is main water outlet holes of the main spraying water group, and the first branch water outlet holes of the first branch spraying water group.
Figure 6:
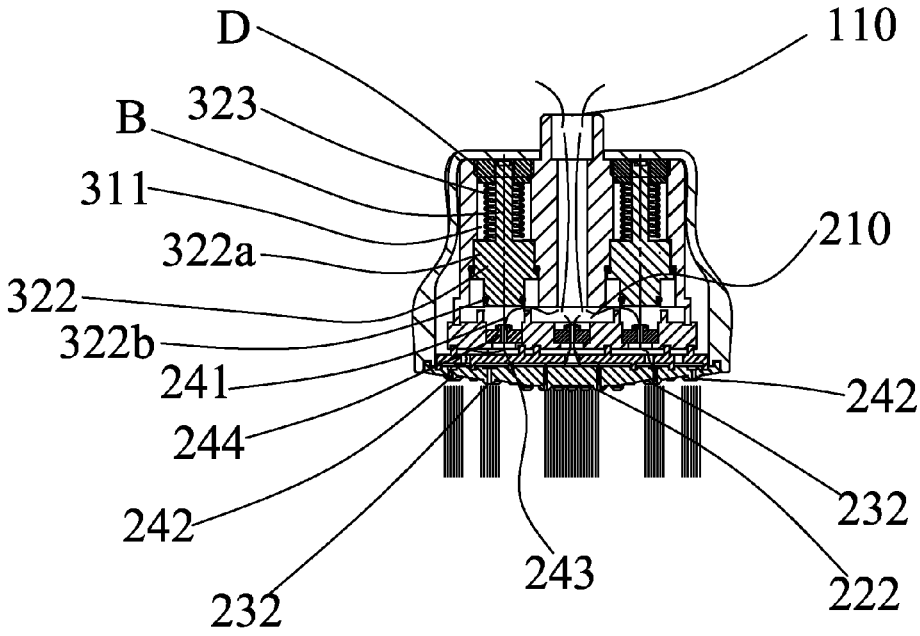
FIG. 6 is a longitude sectional view illustrating the shower having a shower area changed with variation of water pressure in a preferable embodiment of the present invention, when water is simultaneously flowing out of the main water outlet holes of the main spraying water group, the first branch water outlet holes of the first branch spraying water group, and the second branch water outlet holes of the second branch spraying water group.
Figure 7:
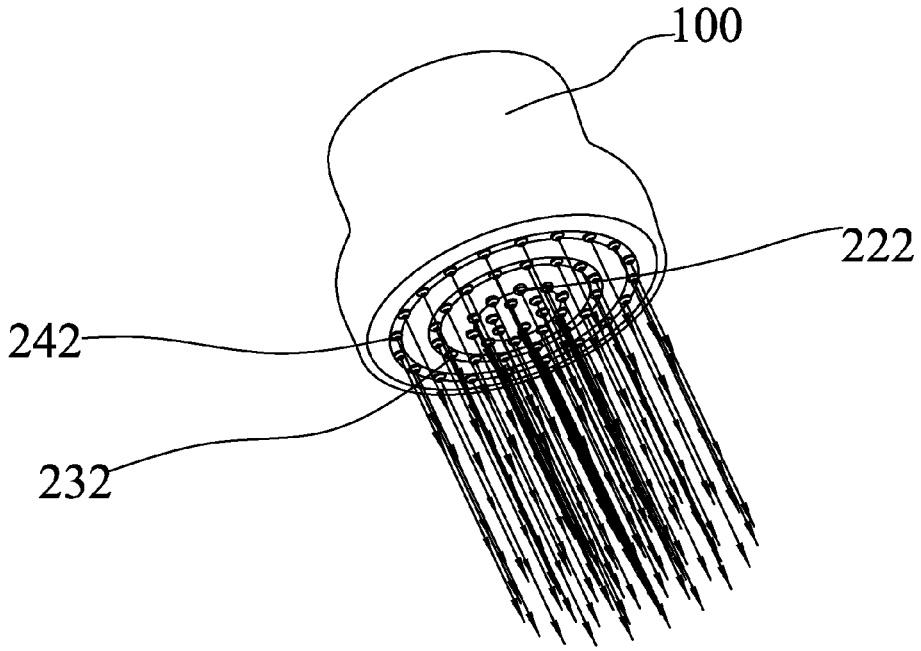
FIG. 7 is a three-dimensional view illustrating the shower having a shower area changed with variation of water pressure in a preferable embodiment of the present invention, when water is simultaneously flowing out of the main water outlet holes of the main spraying water group, the first branch water outlet holes of the first branch spraying water group, and the second branch water outlet holes of the second branch spraying water group.

Referring to FIG. 1, and combining with FIGS. 2, 4, 6, perspective exploded view and sectional views of the shower having shower area changed with variation of water pressure are drawn in one preferable embodiment of the present invention, respectively.

The shower whose shower area can be changed with variation of the to water pressure comprises one holding unit 100, one spraying water unit 200, and two movable units.

The holding unit 100 has a casing 120 and a cylinder block 130. The cylinder block 130 is covered and supported by the casing 120, and the cylinder body 130 extends out of the top of the casing 120. A water is channel 110 is formed inside the cylinder body 130, and the water channel 110 is running through the cylinder block 130, which is also running through the holding unit 100; if it is needed, a feed-water valve can be set up at the top of the water channel 110 to control the water flow, the water pressure will change by regulating the water flow; according to the conditions, the water pressure can also be controlled by the tap of outside water pipe instead of water valve.

The spraying water unit 200 is sealed and fastened under the casing 120, and is sealed and fixed on the cylinder block 130. A middle cavity 210 through the water channel 110 is formed between the spraying water unit 200 and the cylinder block 130. Furthermore, the spraying water unit 200 has three spraying water groups, and they are respective the main spraying water group 220, the first branch spraying water group 230 and the second branch spraying water group 240, the main spraying water group 220 is constantly connecting with the middle cavity 210.

The main spraying water group 220 comprises a main water inlet hole 221 connected with the middle cavity 210, several main water outlet holes 222, a main water outlet cavity 223 connecting the main water inlet hole 221 with several main water outlet holes 222, and a main water-saving chip 224 in the main water inlet hole 221. The first branch spraying water group 230 comprises a first branch water inlet hole 231 connected with the middle cavity 210, several first branch water outlet holes 232, a first branch water outlet cavity 233 connecting the first branch water inlet hole 231 with several first branch water outlet holes 232, and a first branch water-saving chip 234 in the first branch water inlet hole 231. The second branch spraying water group 240 comprises a second branch water inlet hole 241 connected with the middle cavity 210, several second branch water outlet holes 242, a second branch water outlet cavity 243 connecting the second branch water inlet hole 241 with several second branch water outlet holes 242, and a second branch water-saving chip 244 in the second branch water inlet hole 241. The first branch water inlet hole 231 and the second branch water inlet hole 241 are respectively laid out on two sides of the main water inlet hole 221 symmetrically. The first branch water outlet holes 232 of the first branch spraying water group 230 are placed in a circle and surround the main water outlet holes 222 of the main spraying water group 220; The second branch water outlet holes 242 of the second branch spraying water group 240 are placed in a circle and surround the first branch water outlet holes 232 of the first branch spraying water group 230.

Two movable units are defined as the first movable unit 310, the second movable unit 320 respectively, they are assembled with the first branch spraying water group 230 and the second branch spraying water group 240 in one to one correspondence.

The first movable unit 310 comprises:

The first assembly groove 311, set up in the holding unit 100, is the first through hole which is mouth-down, and a screw nut C fixed on the top of the opening of the first through hole is used to seal the first through hole;

The first seal unit 312 which is slip connected with the first through hole of the first assembly groove 311 seals the first through hole. The first seal unit comprises the first piston 312*a* which is multi-diameter and big-end-up, and the first gasket (seal) 312*b* fixed at the bottom of the first piston. The first piston has a down-facing step plane bearing the water pressure in the middle cavity 210, and the first positioning column A is fastened on the upper surface of the first piston 210.

In this embodiment, the elastic body is coil spring, the first spring 313, it is laid out in the first through hole of the first assembly groove 311 covering the first positioning column A and is pressed between the nut C and the first seal unit 312. It presses the first seal unit 312 outwards in order to push it out of the opening below the first assembly groove 311.

The second movable unit 320 comprises:

The second assembly groove 321, set up in the holding unit 100, is the second through hole which is mouth-down, and a screw nut D fixed on the top of the opening of the second thro ugh hole seals the first through hole;

The second seal unit 322 which is slip connected with the second is through hole of the second assembly groove 321 seals the second through hole. The second seal unit comprises the second piston 322*a* which is multi-diameter and big-end-up, and the second gasket (seal) 322*b* fixed at the bottom of the second piston. The second piston has a down-facing step plane bearing the water pressure in the middle cavity 210, and the second positioning column B is fastened on the upper surface of the second piston 210.

In this embodiment, the elastic body is coil spring, the second spring 323, it is laid out in the second through hole of the second assembly groove 321 covering the second positioning column B and is pressed between the nut D and the second seal unit 322. It presses the second seal unit 322 outwards in order to push it out of the opening below the second assembly groove 321.

Choosing different elastic coefficients of the first spring 313 and the second spring 323 or regulating the nut C/D to get different preloads of them, we could get multiple scales of shower area change In the preferable embodiment of the present invention, a working method of a shower having shower area changed with water pressure comprises the following steps:

Step 10, input water pressure change;

Step 20, execute in accordance with water pressure change;

Step 21, when water pressure to the seal unit is more than the elastic is force of elastic body, the seal unit slide away from the water inlet hole of the spraying water group to connect the water inlet hole with middle cavity, then water could flow out of these water outlet holes of the spraying water group, as a result of increasing the shower area;

Step 22, when water pressure to the seal unit is less than the elastic force of elastic body, the seal unit slides close to and seals the water inlet hole of the spraying water group, then water could not flow out of these water outlet holes of the spraying water group, as a result of decreasing the shower area.

For example, in the process of turning on the tap, the method comprises the following steps:

Referring to FIG. 2, 3, firstly, turn on the feed-water valve in the water channel 110 or the tap of the outside water pipe to let water flow through the water channel 110, and at the moment water pressure is less than the elastic forces of the first spring 313 in the first movable unit 310 and the second spring 323 in the second movable unit 320. The first seal unit 312 and the second seal unit 322 both slide outwards to seal the first branch water inlet hole 231 and the second branch water inlet hole 241 respectively. Because the middle cavity 210 is constantly connecting with the main spraying water group 220, water could flow through the main water inlet hole 221, flow into water outlet cavity 223, and at last flow out of the main water outlet holes, meanwhile water could neither flow is out of the first branch spraying water group 230 nor the second branch spraying water group 240. At the moment, the shower area is minimum;

Referring to FIG. 4, 5, as water pressure is increasing, at the moment water pressure is more than the elastic force of the first spring 313 in the first movable unit 310 (but is still less than the elastic force of the second spring 323 in the second movable unit 320). Under the elastic force, the first seal unit 312 of the first movable unit 310 slide inwards to connect the first water inlet hole 231 with the middle cavity 210. So water flows through the first branch water outlet cavity 233 of the first branch spraying water group 230, and at last flows out of the first branch water outlet holes 232 surrounding the main water outlet holes 222. Therefore water is flowing out of the main water outlet holes and the first branch water outlet holes, as a result of increasing the shower area;

Referring to FIG. 6, 7, as water pressure is increasing, at the moment, water pressure is more than any of the elastic forces of the first spring 313 in the first movable unit 310 and the second spring 323 in the second movable unit 320. So at the moment, besides the main water outlet cavity 223 of the main spraying water group 220 and the first branch water outlet cavity 233 of the first spraying water group 230 are connected with the middle cavity 210, under the elastic force, the second branch seal unit 322 of the second branch spraying water group 240 slides inwards to connect the second water inlet hole 241 with the middle cavity 210. Therefore water is simultaneously flowing out of the main water outlet holes 222, the first branch water outlet holes 232, and the second branch water outlet holes 242 in order to increase the shower area to the maximum.

Equivalently, if the feed water valve is turned off slowly, the water pressure is controlled in order to decrease the shower area.

All above is only one preferable embodiment of the present invention, so the present invention should not be limited the shower in the embodiment. In a word, it should be understood that according to the scope of the present invention and the content of the description all the various equivalent modifications and alterations will be apparent in the scope and spirit of this invention.

What is claimed is:

1. A shower having a shower area that is changeable with a variation in water pressure, comprising:

a holding unit, through which a water channel is disposed;

a spraying water unit, which is sealed with the holding unit, a middle cavity being formed between the holding unit and the spraying water unit and being connected with the water channel, the spraying water unit having at least a main spraying water group that is constantly connected with the middle cavity, and at least one branch spraying water group, each of the spraying water groups having a water inlet hole connected with the middle cavity and several water outlet holes connected with a corresponding water inlet hole;

at least one movable unit having an assembly groove forming a through hole and being arranged mouth-down in the holding unit, a nut fixed on a top of the through hole and sealing a top opening thereof, a seal unit that is slidably connected with the through hole and sealing the through hole, and an elastic body disposed in the through hole and which is pressed between the nut and the seal unit and presses outwards against the seal unit, a number of the branch spraying water groups being equal with a number of the movable units, and being assembled together in a one to one correspondence;

wherein when water pressure to the seal unit is less than an elastic force of the elastic body, the seal unit slides outwards to seal a respective water inlet hole; and when water pressure to the seal unit is more than the elastic force of the elastic body, the seal unit slides inwards to connect the respective water inlet hole with the middle cavity.

2. The shower having a shower area changed with variation of water pressure of claim 1, wherein the seal unit has multi-diameters, a big end up piston, and a seal fixed at a bottom of the piston, the bottom of the piston bearing the water pressure.

3. The shower having a shower area changed with variation of water pressure of claim 1, wherein the water outlet holes of the branch spraying water group are laid out in a circle, surrounding the water outlet holes of the main spraying water group.

4. The shower having a shower area changed with variation of water pressure of claim 1, wherein there are at least two of the branch spraying water groups, and at least two of the movable units, each movable unit having an elastic body with a different elastic coefficient.

5. The shower having a shower area changed with variation of water pressure of claim 1, wherein there are at least two of the branch spraying water groups, and at least two of the movable units, each movable unit having an elastic body with a different preload.

6. The shower having a shower area changed with variation of water pressure of claim 2, wherein a positioning column is fixed on an upper surface of the piston, and the elastic body is a coil spring, covering the positioning column.

* * * * *